US011752389B1

(12) United States Patent
Gregoire

(10) Patent No.: US 11,752,389 B1
(45) Date of Patent: Sep. 12, 2023

(54) ARM STRENGTHENING DEVICE

(71) Applicant: Christopher M. Gregoire, Rancho Cordova, CA (US)

(72) Inventor: Christopher M. Gregoire, Rancho Cordova, CA (US)

( * ) Notice: Subject to any disclaimer, the term of this patent is extended or adjusted under 35 U.S.C. 154(b) by 0 days.

(21) Appl. No.: 17/238,391

(22) Filed: Apr. 23, 2021

(51) Int. Cl.

| | |
|---|---|
| ***A63B 21/00*** | (2006.01) |
| ***A63B 21/072*** | (2006.01) |
| ***A63B 15/00*** | (2006.01) |
| ***A63B 21/055*** | (2006.01) |
| ***A63B 23/12*** | (2006.01) |
| ***A63B 23/14*** | (2006.01) |
| ***A63B 23/16*** | (2006.01) |
| *A63B 71/06* | (2006.01) |

(52) U.S. Cl.
CPC ..... *A63B 21/4035* (2015.10); *A63B 15/00* (2013.01); *A63B 21/0557* (2013.01); *A63B 21/0728* (2013.01); *A63B 23/1245* (2013.01); *A63B 23/1281* (2013.01); *A63B 23/14* (2013.01); *A63B 23/16* (2013.01); *A63B 2071/0694* (2013.01); *A63B 2225/09* (2013.01)

(58) Field of Classification Search
CPC ..... A63B 21/4035; A63B 21/0728; A63B 23/1281; A63B 23/14; A63B 2071/0694; A63B 2225/09; A63B 15/00–02; A63B 21/0004; A63B 21/00058–00065; A63B 21/02; A63B 21/05–0557; A63B 21/06–0607; A63B 21/072–075; A63B 21/4023; A63B 21/4033; A63B 23/035; A63B 23/03508; A63B 23/12; A63B 23/1209; A63B 23/1245–16
See application file for complete search history.

(56) References Cited

U.S. PATENT DOCUMENTS

| | | | | |
|---|---|---|---|---|
| 4,029,312 | A * | 6/1977 | Wright | A63B 21/0603 482/106 |
| 7,537,547 | B1 | 5/2009 | Hosick et al. | |
| 8,047,973 | B2 | 11/2011 | Berenshteyn | |
| 8,273,043 | B2 | 9/2012 | Bonutti et al. | |
| 8,679,045 | B2 | 3/2014 | Dao | |
| 8,764,613 | B1 | 7/2014 | Barnes | |
| 9,144,529 | B2 | 9/2015 | Culver | |
| 9,370,702 | B1 * | 6/2016 | O'Reilly | A63B 15/00 |
| 10,166,428 | B2 * | 1/2019 | Giafardino | A63B 21/072 |
| 10,265,568 | B2 | 4/2019 | Silagy et al. | |
| 10,278,881 | B1 | 5/2019 | Branch et al. | |
| 11,278,760 | B1 * | 3/2022 | Hutchinson | A63B 21/4035 |
| 2002/0165070 | A1 * | 11/2002 | Pullaro | A63B 21/072 482/109 |
| 2012/0149539 | A1 * | 6/2012 | Quader | A63B 21/0728 482/109 |
| 2014/0051554 | A1 * | 2/2014 | Walker | A63B 21/0728 482/109 |
| 2014/0057763 | A1 * | 2/2014 | Fritsch | A63B 21/06 482/109 |
| 2014/0213422 | A1 * | 7/2014 | Marcus | A63B 21/0608 482/108 |

(Continued)

*Primary Examiner* — Joshua Lee
*Assistant Examiner* — Catrina A Letterman
(74) *Attorney, Agent, or Firm* — CRAMER PATENT & DESIGN, PLLC; Aaron R. Cramer

(57) ABSTRACT

An arm strengthening device comprises a telescoping rod having a plurality of ergonomic grips at a first end and a removable circular weight perpendicularly disposed at a second end.

10 Claims, 8 Drawing Sheets

(56) References Cited

U.S. PATENT DOCUMENTS

| | | | | |
|---|---|---|---|---|
| 2014/0295983 | A1* | 10/2014 | Nooner | A63B 69/3623 473/223 |
| 2016/0047405 | A1* | 2/2016 | Curley | A63B 23/03525 482/139 |
| 2017/0021219 | A1* | 1/2017 | Kelly | A63B 21/4033 |
| 2017/0095689 | A1* | 4/2017 | Week | A63B 21/0603 |
| 2018/0353793 | A1* | 12/2018 | Sauers | A63B 21/0728 |

* cited by examiner

ARM STRENGTHENING DEVICE

RELATED APPLICATIONS

Non-applicable.

FIELD OF THE INVENTION

The present invention relates generally to the field of exercising devices and more specifically to arm strengthening devices.

BACKGROUND OF THE INVENTION

Physical fitness and health concerns are among the areas of highest concern among Americans today. More than ever, people are frequenting health clubs and performing exercise routines at home in order to lose weight, improve muscle tone and maintain a healthy lifestyle. Several areas of the body that many people concentrate on is the elbow, wrist, hand, and shoulder areas.

Not only do people wish to strengthen and define the muscles in these areas, but many people need to work on these areas during physical therapy when recovering from an accident, illness, or surgery. However, gym equipment designed for such workouts are large, costly and difficult to use while at home or while traveling. Accordingly, there exists a need for a means by which elbow, wrist, hand, and shoulder muscles can be exercised in a manner which addresses the above concerns. The development of the Arm Strengthening Device fulfills this need.

SUMMARY OF THE INVENTION

To achieve the above and other objectives, the present invention provides for an arm strengthening device having a handle section having a length locking collar which allows for extension of an extension tube along an extension travel path, a plurality of indicia disposed along the extension tube representing a plurality of repeatable length settings of the arm strengthening device, and a proximal ergonomic hand grip and a distal ergonomic hand grip disposed on the handle tube.

The length locking collar may be attached to a handle tube via a compression bushing. The length locking collar may be tightened and compresses the compression bushing between the handle tube and the extension tube thereby locking the length locking collar into place. The extension tube may be loosened to allow for movement of the extension tube along the extension travel path by loosening the length locking collar and uncompressing the compression bushing. A distal end of the extension tube may include a removable bushing which holds a circular weight. The removable bushing may include a first hole which accepts a spring pin from the extension tube to quickly remove and replace the circular weight.

The spring pin may be pushed and held while sliding the removable bushing off of the extension tube. The removable bushing may be removed and the spring pin is no longer protruding from a side surface of the removable bushing, the circular weight is freely removed and exchanged. The circular weight may be attached to the extension tube by a threaded connection on a threaded bushing. The circular weight weighs 1¼ lbs. to 2½ lbs. The circular weight may be made of a material selected from the group consisting of cast iron, rubber, or plastic. A resistance band holder may be installed in place of the circular weight and the removable bushing and is held in place with the spring pin via use of a second hole. A slotted keyway may accept and retain the resistance band. The extension tube may be made of a material selected from the group consisting of steel, aluminum, or polyvinyl chloride plastic.

The indicia may be disposed along the extension tube in a linear orientation. The proximal ergonomic hand grip and the distal ergonomic hand grip may be held in place by friction fit. The proximal ergonomic hand grip and the distal ergonomic hand grip may be held in place by adhesive.

A user may be adapted to move the arm strengthening device along a supination travel path. The arm strengthening device may be adapted to be held in a user's left hand or a user's right hand. The arm strengthening device may be adapted to exercise a user's elbow, a user's wrist, a user's hand, and a user's shoulder muscles.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
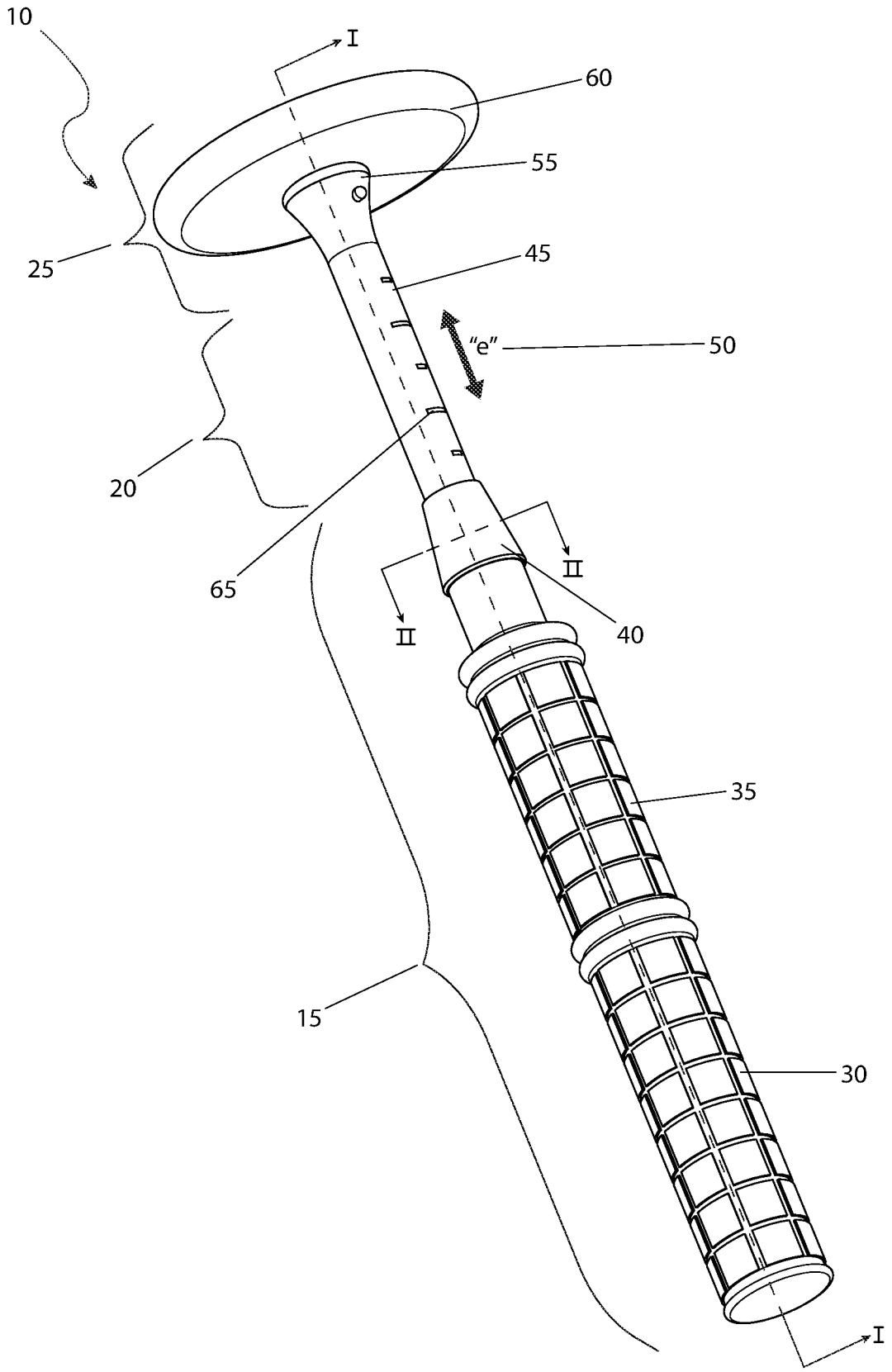
FIG. 1 is a perspective view of the arm strengthening device 10, according to the preferred embodiment of the present invention.

10 arm strengthening device
15 handle section
20 extension section
25 weight head section
30 proximal ergonomic hand grip
35 distal ergonomic hand grip
40 length locking collar
45 extension tube
50 extension travel path "e"
55 removable bushing
60 circular weight
65 indicia
70 first hole
75 spring pin
80 handle tube
85 compression bushing

86 threaded connection
87 threaded bushing
88 threaded rotational direction "t"
90 tightening travel path "cw"
95 loosening travel path "ccw"
100 user
105 hand
110 supination travel path "s"
115 wrist
120 elbow
125 arm
130 pronation travel path "p"
135 resistance band adapter
140 second hole
145 slotted keyway
150 resistance band

DESCRIPTION OF THE PREFERRED EMBODIMENTS

The best mode for carrying out the invention is presented in terms of its preferred embodiment, herein depicted within FIGS. 1 through 8. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the FIGS.

Referring now to FIG. 1, a perspective view of the arm strengthening device 10, according to the preferred embodiment of the present invention is disclosed. The arm strengthening device 10 (herein also described as the "device") 10, comprises an exercise apparatus intended to target the elbow 120, wrist 115, hand 105, and shoulder muscles. The device 10 includes a handle section 15, an extension section 20, and a weight head section 25. The handle section 15 provides for a length locking collar 40 which allows for extension of an extension tube 45 along an extension travel path "e" 50. The distal end of the extension tube 45 is provided with a removable bushing 55 which holds a circular weight 60. The circular weight 60 is envisioned to be manufactured from cast iron and would be made available in different masses such as one and quarter pounds (1¼ lbs.) and two and a half pounds (2½ lbs.). However, other weights, both bigger and smaller, may also be utilized, and as such, the use of any specific size weight should not be interpreted as a limiting factor of the present invention. Also, other materials of manufacture, such as rubber or plastic, can be envisioned for the circular weight 60. The extension tube 45 is envisioned to be made of steel, aluminum, polyvinyl chloride (PVC) plastic, or similar material. A set of indicia 65 is provided in a linear fashion along the length of the extension tube 45 to allow for repeatable settings with regards to the overall usage length of the device 10.

Figure 2:
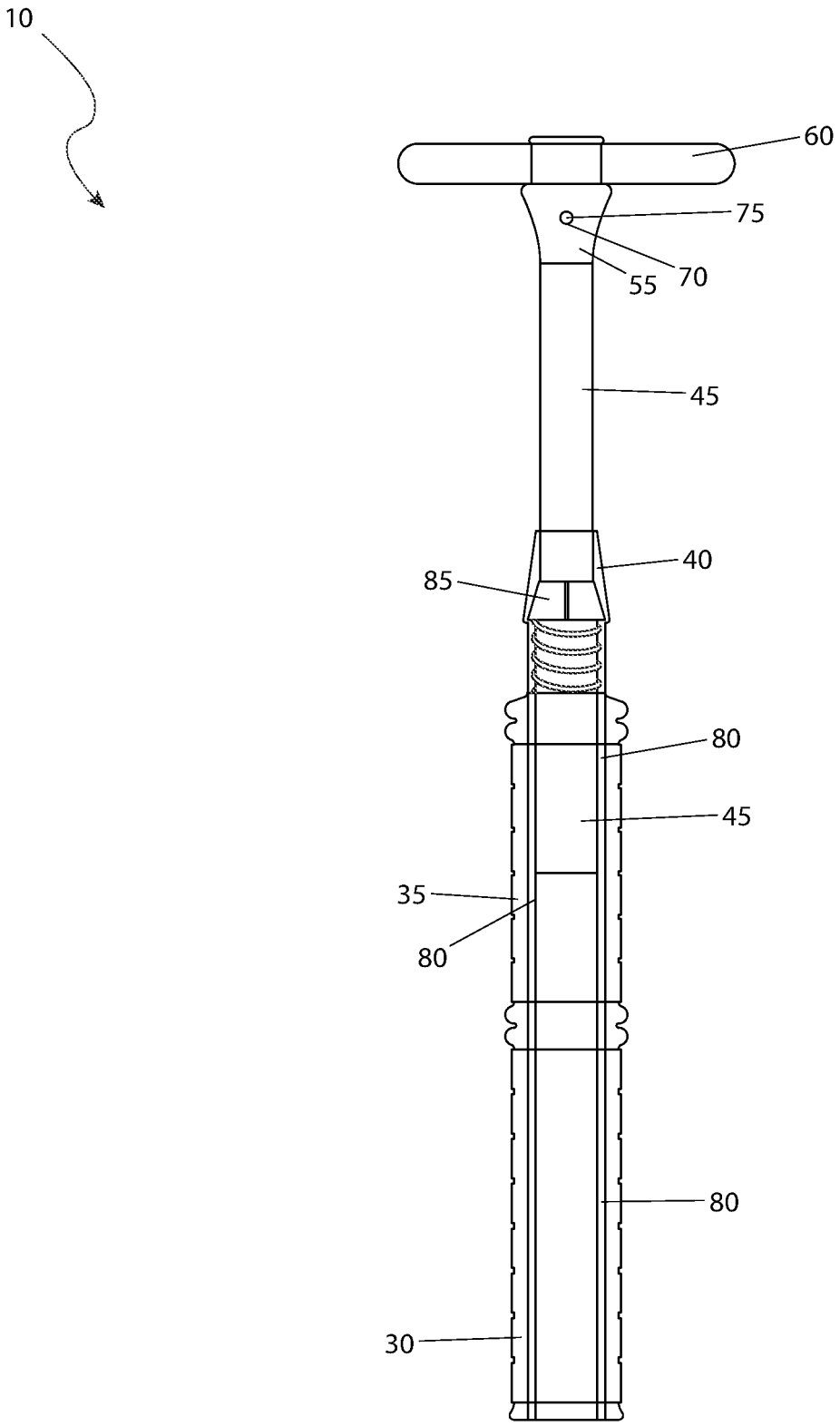
FIG. 2 is a sectional view of the arm strengthening device 10, as seen along a line I-I, as shown in FIG. 1, according to the preferred embodiment of the present invention.

Referring next to FIG. 2, a sectional view of the device 10, as seen along a line I-I, as shown in FIG. 1, according to the preferred embodiment of the present invention is depicted. The circular weight 60 is attached to the extension travel path "e" 50 by the removable bushing 55 as aforementioned described. The removable bushing 55 is provided with a first hole 70 which accepts a spring pin 75 as provided by the extension tube 45. In such a manner, the user may quickly remove and replace the circular weight 60 with a different sized circular weight 60 in the following manner: push and hold the spring pin 75 while sliding the removable bushing 55 off of the extension tube 45. With the removable bushing 55 removed and the spring pin 75 no longer protruding from the side surface of the removable bushing 55, the circular weight 60 may be freely removed and exchanged. The length locking collar 40 is attached to a handle tube 80 via a compression bushing 85. As the length locking collar 40 is tightened, it compresses the compression bushing 85 between the handle tube 80 and the extension tube 45 thus locking it into place. The loosening of the extension tube 45, to allow for movement of the extension tube 45 along the extension travel path "e" 50 (as shown in FIG. 1) is accomplished by reversing this approach and loosening of the length locking collar 40 and uncompressing of the compression bushing 85. The proximal ergonomic hand grip 30 and the distal ergonomic hand grip 35 are placed directly on the handle tube 80 and are held in place by friction fit, adhesive, or the like.

Figure 6:
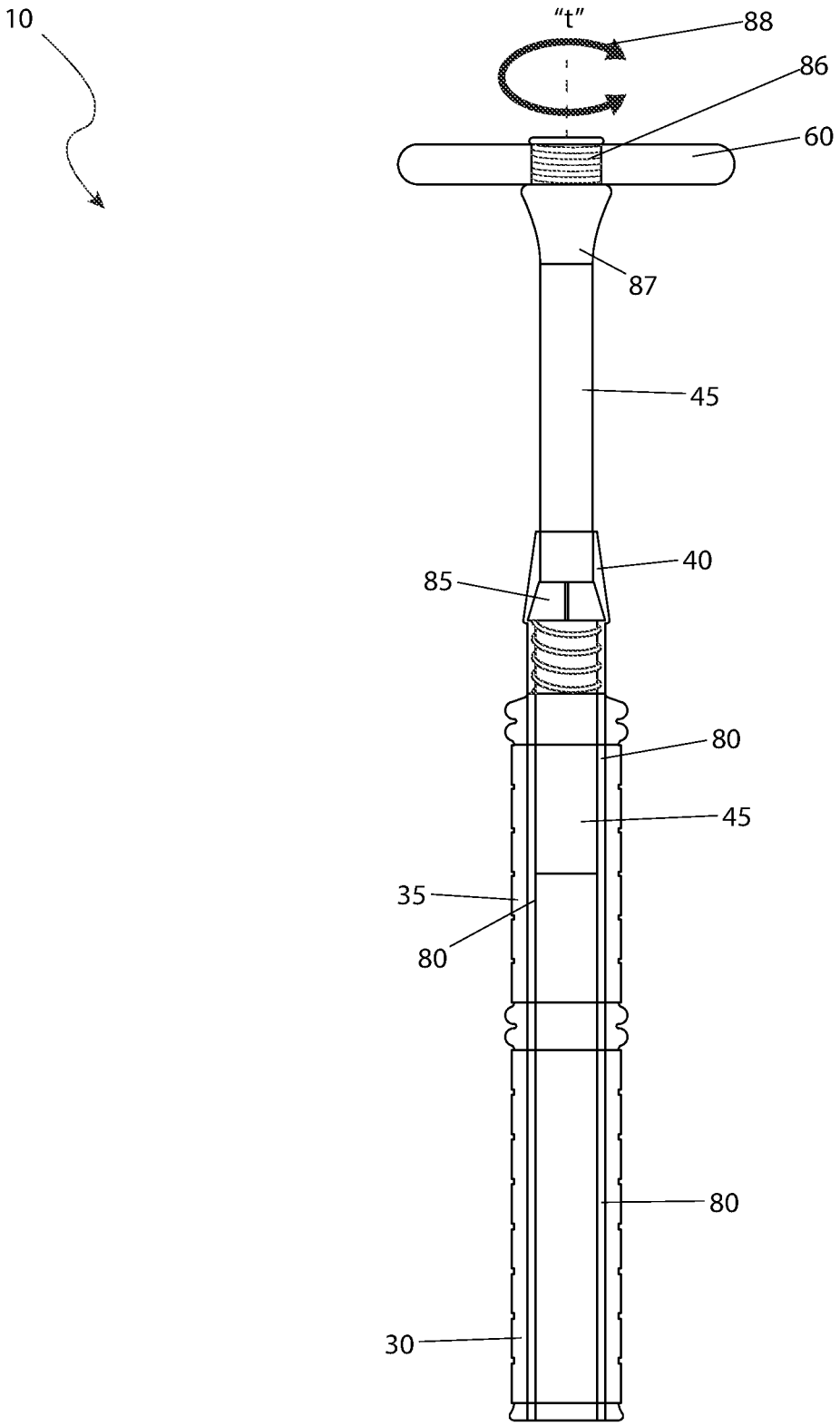
FIG. 6 is a sectional view of the arm strengthening device 10, as seen along a line I-I, as shown in FIG. 1, according to an alternate embodiment of the present invention.

Referring next to FIG. 6, a sectional view of the device 10, as seen along a line I-I, as shown in FIG. 1, according to an alternate embodiment of the present invention is depicted. In this alternate embodiment, the circular weight 60 is attached to the extension tube 45 by a threaded connection 86 on a threaded bushing 87. In such a manner the circular weight 60 may be removed from the threaded bushing 87 by rotating it along a circular threaded rotational direction "t" 88. In such a manner, the user may quickly remove and replace the circular weight 60 with a different sized circular weight 60. The balance of the device 10 remains the same as the preferred embodiment with a locking collar 40 is attached to a handle tube 80 via a compression bushing 85. As the length locking collar 40 is tightened, it compresses the compression bushing 85 between the handle tube 80 and the extension tube 45 thus locking it into place. The loosening of the extension tube 45, to allow for movement of the extension tube 45 along the extension travel path "e" 50 (as shown in FIG. 1) is accomplished by reversing this approach and loosening of the length locking collar and uncompressing of the compression bushing 85. The proximal ergonomic hand grip 30 and the distal ergonomic hand grip 35 are placed directly on the handle tube 80 and are held in place by friction fit, adhesive, or the like.

Figure 3:
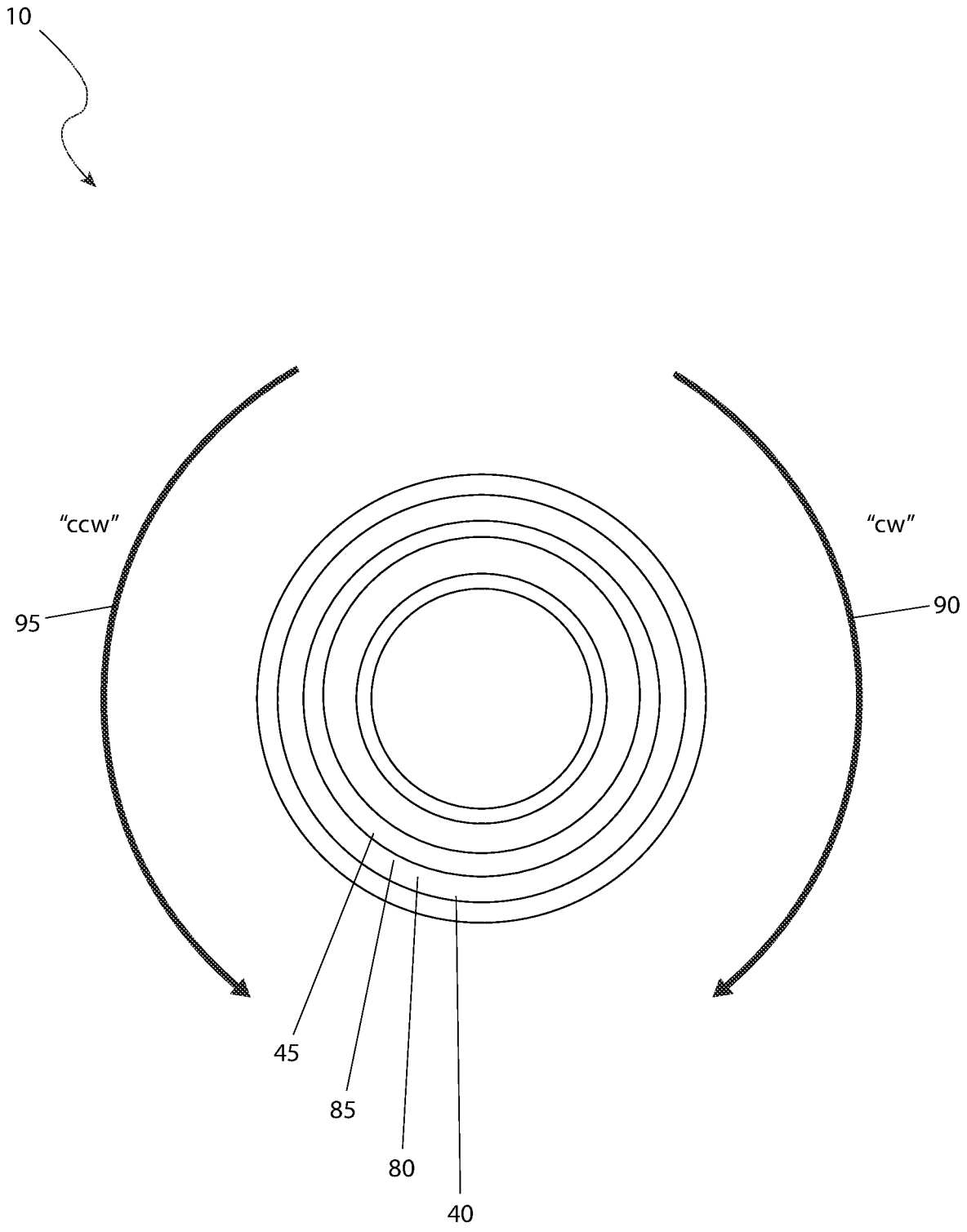
FIG. 3 is a sectional view of the arm strengthening device 10, as seen along a line II-II, as shown in FIG. 1, according to the preferred embodiment of the present invention.

Referring now to FIG. 3, a sectional view of the device 10, as seen along a line II-II, as shown in FIG. 1, according to the preferred embodiment of the present invention is shown. This view is taken at the distal junction of the handle tube 80 and the extension tube 45 as encircled by the length locking collar 40. The extension tube 45 is located on the innermost section of the concentric arrangement. The handle tube 80 is provided next in loose, but physical contact with the extension tube 45. The compression bushing 85 is located at the junction between extension tube 45 and the handle tube 80 and is compressed by the length locking collar 40 when tightened along a tightening travel path "cw" 90. Such action mechanically locks the extension tube 45 to the handle tube 80. Similarly, when the length locking collar 40 is moved along a loosening travel path "ccw" 95, the force on the compression bushing 85 is reduced, allowing the connection between the extension tube 45 and the handle tube 80 to be moved or extended along the extension travel path "e" 50 (as shown in FIG. 1).

Figure 4:
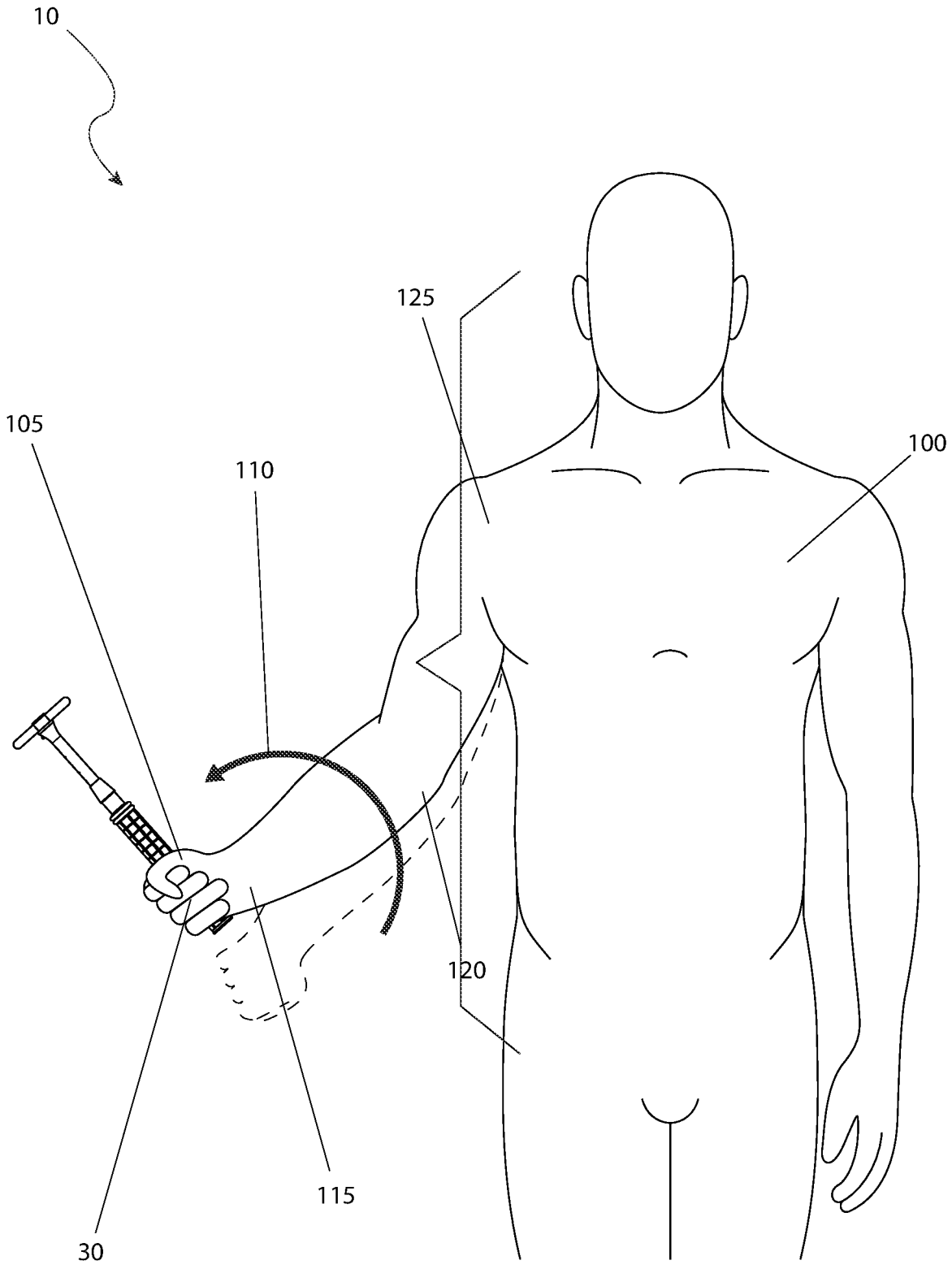
FIG. 4 is a perspective view of the arm strengthening device 10, shown in a utilized state, according to the preferred embodiment of the present invention.

Referring next to FIG. 4, a perspective view of the device 10, shown in a utilized state, according to the preferred embodiment of the present invention is disclosed. The usage depicts supination movement. A user 100 holds the device 10 in either their left or right hand 105 (here depicted as the right hand 105), by either the proximal ergonomic hand grip 30 or the distal ergonomic hand grip 35 (here shown by the proximal ergonomic hand grip 30). The user 100 then moves the device 10 along a supination travel path "s" 110 to exercise the wrist 115, the elbow 120 and the arm 125. The movement along the supination travel path "s" 110 would be for conventional muscle strengthening means but is also viewed as beneficial for those recovering from surgery or an accident.

Figure 5:
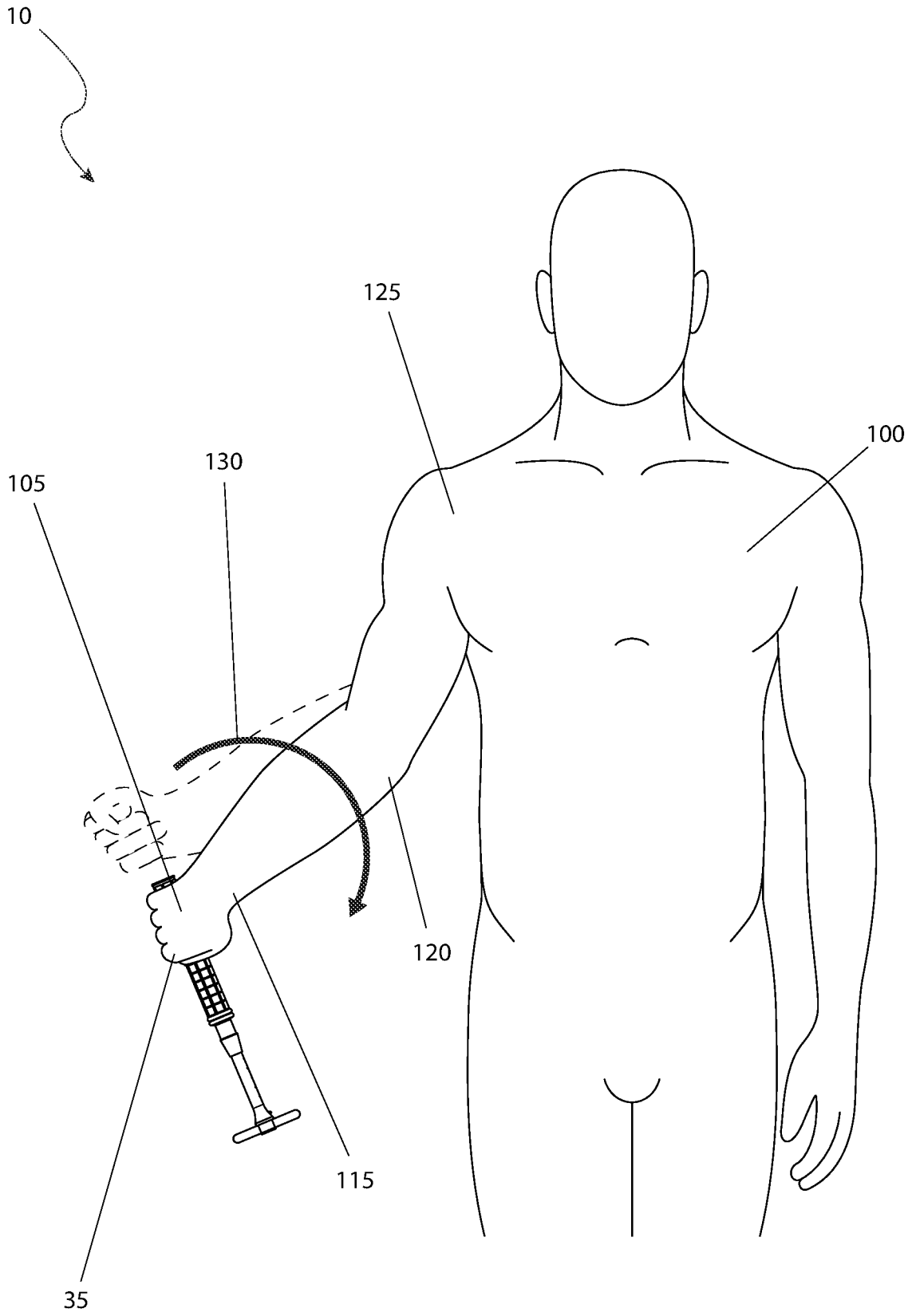
FIG. 5 is a perspective view of the arm strengthening device 10, shown in an alternate utilized state, according to the preferred embodiment of the present invention.

Referring to FIG. 5, a perspective view of the device 10, shown in an alternate utilized state, according to the preferred embodiment of the present invention is depicted. The usage depicts pronation movement. The user 100 holds the device 10 in either their left or right hand 105 (here depicted as the right hand 105), by either the proximal ergonomic hand grip 30 or the distal ergonomic hand grip 35 (here shown by the distal ergonomic hand grip 35). The user 100 then moves the device 10 along a pronation travel path "p" 130 to exercise the wrist 115, the elbow 120 and the arm 125. The movement along the pronation travel path "p" 130 would be for conventional muscle strengthening means but is also viewed as beneficial for those recovering from surgery or an accident.

Figure 7:
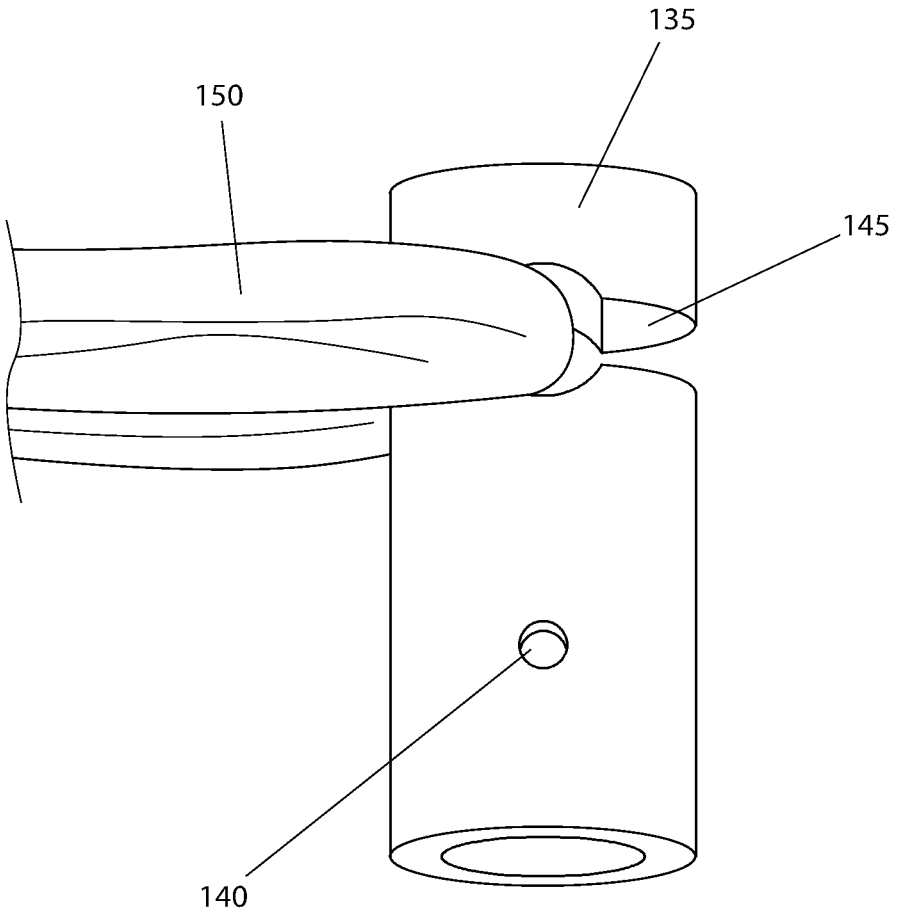
FIG. 7 is a detailed view of a resistance band holder 135, as used with the arm strengthening device, according to the preferred embodiment of the present invention; and, FIG. 8 is a detailed view of the resistance band holder 135, as used with the arm strengthening device, according to the alternate embodiment of the present invention.

Referring to FIG. 7, a detailed view of a resistance band holder 135, as used with the arm strengthening device, according to the preferred embodiment of the present invention is shown. The resistance band holder 135 is installed in place of the circular weight 60 and the removable bushing 55 (as shown in FIG. 2) and is held in place via use of the spring pin 75 (as shown in FIG. 2) via use of a second hole 140. A slotted keyway 145 accepts and retains a resistance band 150 of conventional design. The distal end of the resistance band 150 is then attached to a fixed object for use in exercising. The balance of components and operation remains identical to that described in FIG. 2.

Figure 8:
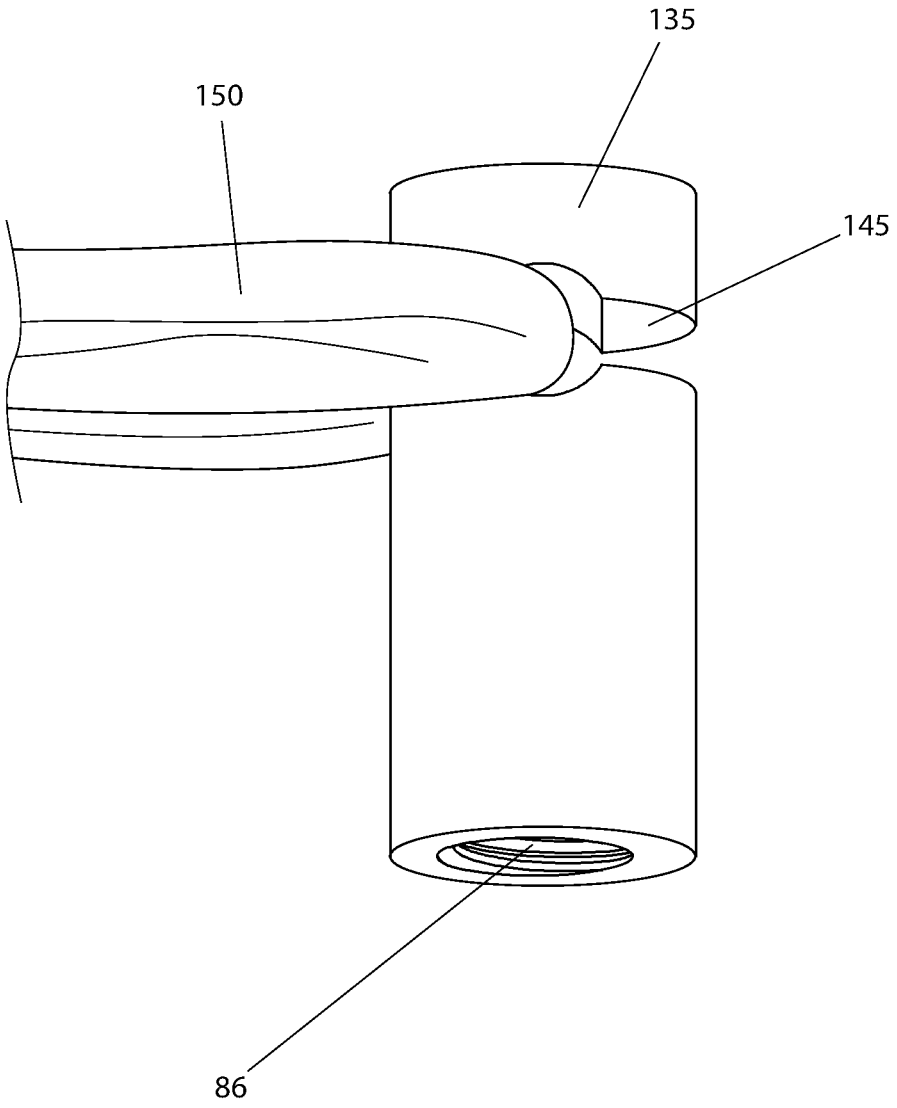

Referring to FIG. 8, a detailed view of the resistance band holder 135, as used with the arm strengthening device, according to the alternate embodiment of the present invention is disclosed. The resistance band holder 135 is installed in place of the circular weight 60 upon the threaded bushing 87 (as shown in FIG. 6) and is held in place via use of a threaded connection 86 (also shown in FIG. 2). The slotted keyway 145 accepts and retains a resistance band 150 of conventional design. The distal end of the resistance band 150 is then attached to a fixed object for use in exercising. The balance of components and operation remains identical to that described in FIG. 6.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 6. The user 100 would procure the device 10 from conventional procurement channels such as sporting goods stores, home health suppliers, medical suppliers, mail order and internet supply houses and the like. Special attention would be paid to the overall size of the device as well as the materials of construction.

After procurement and prior to utilization, the device 10 would be prepared in the following manner: the user 100 would apply the desired sized circular weight 60 by pushing and holding the spring pin 75 while sliding the removable bushing 55 off of the extension tube 45; with the removable bushing 55 removed and the spring pin 75 no longer protruding from the side surface of the removable bushing 55, the circular weight 60 may be freely removed and exchanged as desired; the user 100 would select the desired overall length of the device 10 as a long device 10 would impart more centripetal force and thus increase the exertion of the workout; the overall length of the device 10 is determined by the amount of overlap between the extension tube 45 and the handle tube 80; the length locking collar 40 is loosened along the loosening travel path "ccw" 95 to disengage the compression bushing 85 between the extension tube 45 and the handle tube 80; the extension tube 45 is adjusted using the indicia 65 as a guide; once properly selected; the length locking collar 40 is tightened along the tightening travel path "cw" 90 to physically engage the compression bushing 85 between the extension tube 45 and the handle tube 80. Should the resistance band 150 be used in lieu of the circular weight 60, the resistance band holder 135 is attached to the arm strengthening device 10 via the removable bushing 55 or the threaded bushing 87, with the resistance band 150 secured in the slotted keyway 145. At this point in time, the device 10 is ready for use.

During utilization of the arm strengthening device 10, the following procedure would be initiated: the user 100 would hold the device 10 in either their left or right hand 105 as desired, using either the proximal ergonomic hand grip 30 or the distal ergonomic hand grip 35 as desired. The use of the proximal ergonomic hand grip 30 will require more force, and thus more exertion, than the distal ergonomic hand grip 35. The use of the distal ergonomic hand grip 35 effectively shortens the overall length of the extension section 20, thus making it easier to move. Movements along the supination travel path "s" 110 and the pronation travel path "p" 130 are then repeated as desired, with intermediate changes using either the left or right hand 105 as desired. Static weight resistance is provided by the circular weight 60 or the resistance band 150.

The use of the device 10 is envisioned for conventional muscle strengthening means. Additional uses of the device 10 include, but are not limited to, recovery and physical therapy after surgery or an accident.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. An arm strengthening device, comprising:

a handle section having a length locking collar which allows for extension of an extension tube along an extension travel path;

a plurality of indicia disposed along the extension tube representing a plurality of repeatable length settings of the arm strengthening device; and a proximal ergonomic hand grip and a distal ergonomic hand grip disposed on a handle tube, wherein a distal end of the extension tube includes a removable bushing which holds a circular weight;

wherein the removable bushing includes a first hole which accepts a spring pin from the extension tube to quickly remove and replace the circular weight;

a resistance band holder installable in place of the circular weight and the removable bushing upon removal of the removable bushing and the circular weight from the distal end of the extension tube, wherein the resistance band holder is held in place with the spring pin via use of a second hole;

wherein the resistance band holder includes a slotted keyway that accepts and retains a resistance band;

wherein the length locking collar is attached to the handle tube via a compression bushing;

wherein the length locking collar is tightened and compresses the compression bushing between the handle tube and the extension tube thereby locking the length locking collar into place;

wherein the extension tube is loosened to allow for movement of the extension tube along the extension travel path by loosening the length locking collar and uncompressing the compression bushing;

wherein the spring pin is pushed and held while sliding the removable bushing off of the extension tube; and, wherein when the removable bushing is removed and the spring pin is no longer protruding from a side surface of the removable bushing, the circular weight is freely removed and exchanged.

2. The arm strengthening device, according to claim 1, wherein the circular weight weighs 1-/4 lbs. to 2-12 lbs.

3. The arm strengthening device, according to claim 1, wherein the circular weight is made of a material selected from the group consisting of cast iron, rubber, or plastic.

4. The arm strengthening device, according to claim 1, wherein the extension tube is made of a material selected from the group consisting of steel, aluminum, or polyvinyl chloride plastic.

5. The arm strengthening device, according to claim 1, wherein the indicia is disposed along the extension tube in a linear orientation.

6. The arm strengthening device, according to claim 1, wherein the proximal ergonomic hand grip and the distal ergonomic hand grip are held in place by friction fit.

7. The arm strengthening device, according to claim 1, wherein the proximal ergonomic hand grip and the distal ergonomic hand grip are held in place by adhesive.

8. The arm strengthening device, according to claim 1, wherein the arm strengthening device is adapted to be used by a user along a supination travel path.

9. The arm strengthening device, according to claim 1, wherein the arm strengthening device is adapted to be held in a user's left hand or a user's right hand.

10. The arm strengthening device, according to claim 1, wherein the arm strengthening device is adapted to exercise a user's elbow, a user's wrist, a user's hand, and a user's shoulder muscles.

* * * * *